US009372432B2

(12) United States Patent
Yano et al.

(10) Patent No.: US 9,372,432 B2
(45) Date of Patent: Jun. 21, 2016

(54) OPTICAL PRINT HEAD AND IMAGE FORMING DEVICE

(71) Applicant: KONICA MINOLTA, INC., Chiyoda-ku, Tokyo (JP)

(72) Inventors: So Yano, Ibaraki (JP); Yoshikazu Watanabe, Toyohashi (JP); Makoto Obayashi, Toyokawa (JP); Masayuki Iijima, Okazaki (JP); Takaki Uemura, Seto (JP); Satoshi Masuda, Neyagawa (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 0 days.

(21) Appl. No.: 14/790,341

(22) Filed: Jul. 2, 2015

(65) Prior Publication Data

US 2016/0011535 A1 Jan. 14, 2016

(30) Foreign Application Priority Data

Jul. 9, 2014 (JP) ..... 2014-141105

(51) Int. Cl.
*G03G 15/00* (2006.01)
*G03G 15/043* (2006.01)

(52) U.S. Cl.
CPC ..... *G03G 15/043* (2013.01)

(58) Field of Classification Search
CPC ..... G03G 15/043
USPC ..... 399/4; 347/130, 119
See application file for complete search history.

(56) References Cited

U.S. PATENT DOCUMENTS 5,300,960 A * 4/1994 Pham ..... G06K 15/1261 347/130
2010/0216333 A1 8/2010 Hane et al.

FOREIGN PATENT DOCUMENTS

| | | | |
|---|---|---|---|
| JP | 2004-246182 | A | 9/2004 |
| JP | 2006-56010 | A | 3/2006 |
| JP | 2006-95787 | A | 4/2006 |
| JP | 2010-200514 | A | 9/2010 |

* cited by examiner

*Primary Examiner* — Susan Lee
(74) *Attorney, Agent, or Firm* — Buchanan Ingersoll & Rooney PC

(57) ABSTRACT

An optical print head for forming an electrostatic latent image on a photosensitive body, including: current-driven light-emitting elements disposed in a line shape; an indicator circuit that outputs indicator current indicating light emission amounts to the light-emitting elements; and for each light-emitting element: a holding circuit that, during a main scanning period, accumulates indicator current during a sample period to generate an indicator potential and holds the indicator potential during a hold period; and a drive circuit that supplies drive current to the light-emitting element according to the indicator potential, wherein each of the sample periods is divided into writing periods, and each of the holding circuits holds the indicator potential corresponding to the holding circuit according to a total of indicator current amounts in the sample period corresponding to the holding circuit, the indicator current amounts each indicative of indicator current during one of the writing periods.

16 Claims, 14 Drawing Sheets

FIG. 8

| Bit position | Writing data | | | | | |
|---|---|---|---|---|---|---|
| | 1st | 2nd | 3rd | 4th | 5th | 6th |
| 8 (25.6μA) | 1 | 1 | 1 | 1 | 1 | 1 |
| 7 (12.8μA) | 1 | 1 | 1 | 1 | 1 | 1 |
| 6 ( 6.4μA) | 1 | 1 | 1 | 1 | 1 | 1 |
| 5 ( 3.2μA) | 1 | 1 | 1 | 1 | 1 | 1 |
| 4 ( 1.6μA) | 1 | 1 | 1 | 1 | 0 | 0 |
| 3 ( 0.8μA) | 1 | 1 | 1 | 1 | 1 | 0 |
| 2 ( 0.4μA) | 1 | 1 | 1 | 0 | 0 | 0 |
| 1 ( 0.2μA) | 1 | 1 | 0 | 0 | 0 | 0 |
| Output current | 51.0μA | 51.0μA | 50.8μA | 50.4μA | 48.8μA | 48.0μA |

| Block number | Correction amount |
|---|---|
| 001～015 | 0 % |
| 016～030 | 1 % |
| 031～045 | 2 % |
| 046～060 | 3 % |
| 061～075 | 4 % |
| 076～090 | 5 % |
| 091～105 | 6 % |
| 106～120 | 7 % |
| 121～135 | 8 % |
| 136～150 | 9 % |

FIG. 12

| Bit position | Writing data | | | | | | | |
|---|---|---|---|---|---|---|---|---|
| | 1st | 2nd | 3rd | 4th | 5th | 6th | 7th | 8th |
| 8 (25.6μA) | 1 | 1 | 1 | 1 | 1 | 1 | 1 | 0 |
| 7 (12.8μA) | 1 | 1 | 1 | 1 | 1 | 1 | 0 | 0 |
| 6 ( 6.4μA) | 1 | 1 | 1 | 1 | 1 | 1 | 0 | 0 |
| 5 ( 3.2μA) | 1 | 1 | 1 | 1 | 1 | 1 | 0 | 0 |
| 4 ( 1.6μA) | 1 | 1 | 1 | 1 | 1 | 0 | 0 | 0 |
| 3 ( 0.8μA) | 1 | 1 | 1 | 1 | 0 | 0 | 0 | 0 |
| 2 ( 0.4μA) | 1 | 1 | 1 | 0 | 0 | 1 | 0 | 0 |
| 1 ( 0.2μA) | 1 | 1 | 1 | 0 | 0 | 0 | 0 | 0 |
| Output current | 51.0μA | 51.0μA | 51.0μA | 50.4μA | 49.6μA | 48.4μA | 25.6μA | 0.0μA |

| Light emitting blocks 402 that have substantially the same wiring capacitance |
|---|
| 001～015、136～150 |
| 016～030、121～135 |
| 031～045、106～120 |
| 046～060、091～105 |
| 061～075、076～090 |

Relationship of potential and drop amount

Relationship of potential and luminance

OPTICAL PRINT HEAD AND IMAGE FORMING DEVICE

CROSS-REFERENCE TO RELATED APPLICATION

This application is based on an application No. 2014-141105 filed in Japan, the contents of which are hereby incorporated by reference.

BACKGROUND OF THE INVENTION (1) Field of the Invention

The present invention relates to optical print heads and image forming devices, and in particular to technology implementing high image quality optical writing at low cost.

(2) Description of the Related Art

In recent years, an optical print head (PH) using organic light emitting diodes (OLEDs) has been proposed with an aim of reducing size and cost of an image forming device. The OLEDs are arranged in a line along a main scanning direction on a thin film transistor (TFT) substrate, and are electrically connected in parallel by power supply wiring provided along the main scanning direction (FIG. 16).

OLEDs are also called organic electro-luminescence (EL) elements. OLEDs are current-driven light-emitting elements, and when drive current is supplied to the OLEDs via the power supply wiring, a voltage drop occurs along the power supply wiring according to wiring resistance.

Drive transistors generating drive current for the OLEDs are arranged adjacent to the OLEDs in a one-to-one correspondence, and each drive transistor generates drive current according to a potential difference between potential at a connection of the power supply wiring and input voltage (luminance signal) from a digital to analogue converter (DAC). Thus, voltage drop of the power supply wiring leads to a decrease of reference potential, causing fluctuations in drive current of the OLEDs, and therefore emitted luminance fluctuates and uneven concentration occurs (FIG. 17A and FIG. 17B).

With respect to this problem, technology has been proposed to cause a capacitor to hold a source-gate voltage (hereafter, "gate voltage") occurring due to drive current corresponding to luminance and an equal current energizing a source-drain of a drive transistor. In this way, drive current according to the voltage (luminance signal) held in the capacitor is supplied, and potential at the connection of the power supply wiring need not be the reference potential. Accordingly, a desired drive current is supplied to the OLEDs regardless of voltage drop of the power supply wiring, and uneven concentration can be eliminated.

Human vision is not sensitive to uneven luminance in moving images, and therefore, among monitor devices such as liquid crystal display monitors and OLED monitors, luminance unevenness up to 30% is allowable in a monitor screen. Further, in existing monitor devices, 256 grades for each color channel suffices, and therefore 8-bit DACs are sufficient. The reason for such a high tolerance for luminance unevenness and the low number of bits for DACs is that cost of monitor devices can be reduced.

In the case of OLED print heads, the dynamic range of luminance is 300%. Further, human sight is sensitive to uneven brightness in still images, and therefore an allowable amount of luminance unevenness is only a few percent. Thus, for example, in a case in which luminance unevenness is to be suppressed to no greater than 3%, the following is considered.

In order that luminance unevenness is no greater than 3%, resolution of luminance control must be one in ten of 3%, i.e. no greater than 0.3%. Further, for luminance control of a dynamic range of 300% at a resolution of 0.3%, luminance control must be performed at 300%÷0.3%=1000 grades for each color channel. Thus, 10-bit DACs are required for the conventional technology above.

Of course, as the number of bits for DACs increases, costs increase proportionately, and therefore increased costs are unavoidable when applying the conventional technology above.

SUMMARY OF THE INVENTION

The present invention has been achieved in view of the problems described above, and aims to provide an optical print head and image forming device that eliminates luminance unevenness without leading to cost increases.

In order to achieve the above aims, the optical print head pertaining to the present invention is an optical print head for forming an electrostatic latent image on a photosensitive body, the optical print head comprising: a plurality of current-driven light-emitting elements disposed in a line shape; an indicator circuit that outputs indicator current indicating light emission amounts to the light-emitting elements; and for each light-emitting element among the light-emitting elements: a corresponding holding circuit that, during a main scanning period, accumulates indicator current during a corresponding sample period to generate an indicator potential and holds the indicator potential during a corresponding hold period; and a corresponding drive circuit that supplies drive current to the light-emitting element according to the indicator potential, wherein each of the sample periods is divided into a plurality of writing periods, and each of the holding circuits holds the indicator potential corresponding to the holding circuit according to a total of indicator current amounts in the sample period corresponding to the holding circuit, the indicator current amounts each indicative of indicator current during one of the writing periods.

BRIEF DESCRIPTION OF THE DRAWINGS

These and the other objects, advantages and features of the invention will become apparent from the following description thereof taken in conjunction with the accompanying drawings which illustrate a specific embodiment of the invention.

In the drawings:

FIG. 8 is a table showing writing data.

FIG. 12 is a table showing writing data with respect to a far end light emitting block 402 pertaining to a modification of the present invention.

FIG. 13A is related to a far end light emitting block 402 and FIG. 13B is related to a near end light emitting block 402.

DESCRIPTION OF THE PREFERRED EMBODIMENT

The following describes an optical print head and an image forming device according to a preferred embodiment of the present invention, with reference to the drawings.

(1) Configuration of Image Forming Device

First, a configuration of an image forming device pertaining to the present embodiment is described below.

Figure 1:
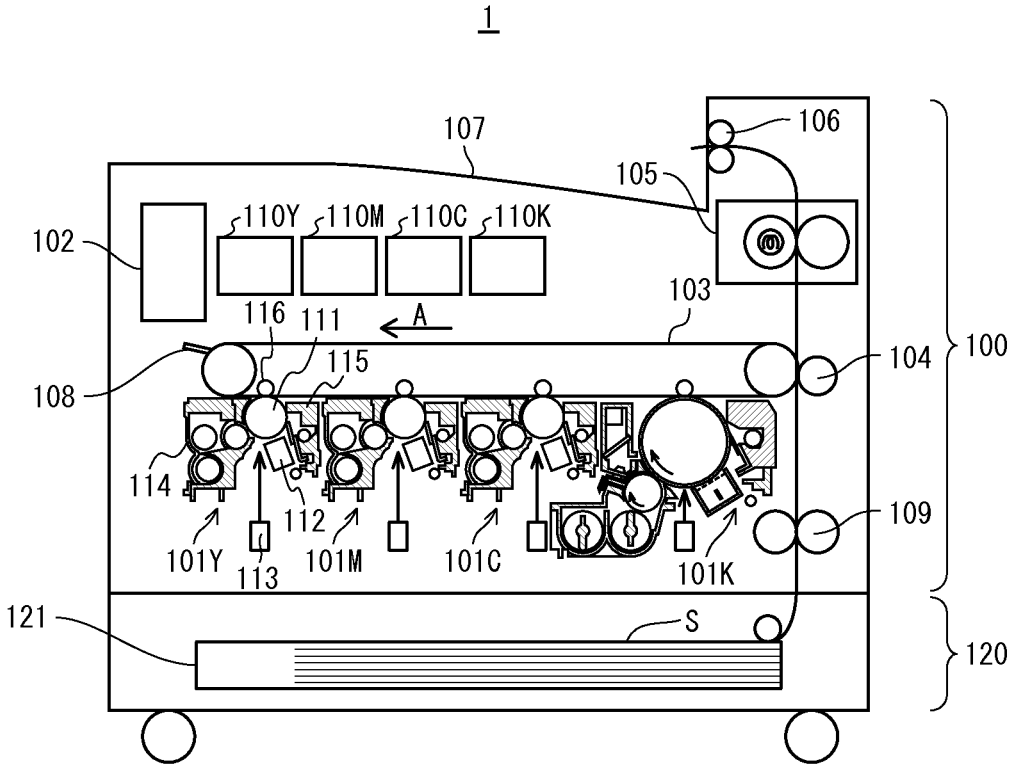
FIG. 1 shows major components of an image forming device pertaining to an embodiment of the present invention.

FIG. 1 shows major components of an image forming device pertaining to the present embodiment. As shown in FIG. 1, an image forming device 1 is a tandem-type color printer device that includes an image former 100 and a paper feeder 120.

The image former 100 includes imaging units 101Y, 101M, 101C, 101K, a controller 102, an intermediate transfer belt 103, a secondary transfer roller pair 104, a fixing device 105, a paper ejection roller pair 106, a paper ejection tray 107, a cleaning blade 108, and a timing roller pair 109. Further, toner cartridges 110Y, 110M, 110C, 110K are mounted onto the image former 100, supplying toner that is yellow (Y), magenta (M), cyan (C), and black (K), respectively.

The imaging units 101Y to 101K receive toner supplied from the toner cartridges 110Y to 110K, respectively, to form toner images in each of the colors Y, M, C, and K under control of the controller 102. For example, the imaging unit 101Y includes a photosensitive drum 111, a charging device 112, an optical print head 113, a developer device 114, and a cleaning device 115. Under control of the controller 102, the charging device 112 causes an outer circumferential surface of the photosensitive drum 111 to be uniformly charged.

The controller 102 generates a digital luminance signal for causing the optical print head 113 to emit light, according to an internal application specific integrated circuit (ASIC, hereafter "luminance signal output unit") and based on image data for printing that is included in a received job. The optical print head includes, as described later, light-emitting elements (OLEDs) arranged in a line shape in a main scanning direction. The optical print head performs optical writing on the outer circumferential surface of the photosensitive drum 111 to form an electrostatic latent image, by causing each OLED to emit light according to a digital luminance signal generated by the controller 102.

The developer device 114 supplies toner to the outer circumferential surface of the photosensitive drum 111 to develop (visualize) the electrostatic latent image. A primary transfer voltage is applied to a primary transfer roller 116, causing an electrostatic transfer (primary transfer) of the toner image carried on the outer circumferential surface of the photosensitive drum 111 to the intermediate transfer belt 103 by electrostatic attraction. Subsequently, the cleaning device 115 scrapes off toner remaining on the outer circumferential surface of the photosensitive drum 111 by means of a cleaning blade and, further, removes charge by illuminating the outer circumferential surface of the photosensitive drum 111.

In the same way, the imaging units 101M, 101C, 101K also form M, C, K toner images, respectively. These toner images are superimposed, in order, onto the intermediate transfer belt 103 by primary transfer, forming a color toner image. The intermediate transfer belt 103 is an endless rotating body, rotates in the direction of an arrow A, and transports to the secondary transfer roller pair 104 a toner image that has been transferred by primary transfer.

The paper feeder 120 includes a paper feed cassette 121 that stores recording sheets S and supplies the recording sheets S to the image former 100 one sheet at a time. A supplied one of the recording sheets S is transported in parallel with transport of a toner image by the intermediate transfer belt 103 and transported to the secondary transfer roller pair 104 via the timing roller pair 109. The timing roller pair 109 transports one of the recording sheets S to coincide with a timing of arrival of a toner image at the secondary transfer roller pair 104.

The secondary transfer roller pair 104 is composed of a pair of rollers to which a secondary transfer voltage is applied. The pair of rollers are pressed against each other to form a secondary transfer nip. In this transfer nip, a toner image on the intermediate transfer belt 103 is transferred onto one of the recording sheets S by electrostatic transfer (secondary transfer). The one of the recording sheets S onto which the toner image is transferred is transported to the fixing device 105. Further, after the secondary transfer, toner that remains on the intermediate transfer belt 103 is transported farther in the direction of the arrow A then scraped off by the cleaning blade 108 and discarded.

The fixing device 105 heats and melts the toner image, pressure bonding the toner image onto the one of the recording sheets S. The one of the recording sheets S onto which the toner image is fused is ejected onto the paper ejection tray 107 by the paper ejection roller pair 106.

When the controller 102 receives a print job from a personal computer (PC) or other device, the controller 102 controls operation of the image forming device 1, as described above, to cause the print job to be executed.

(2) Configuration of Optical Print Head 113

The following is a description of configuration of the optical print head 113.

Figure 2:
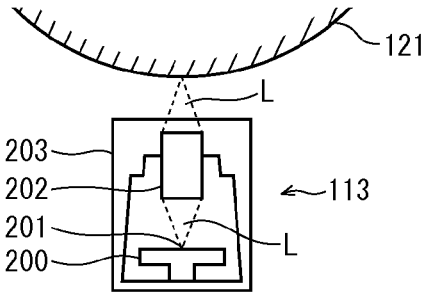
FIG. 2 is a cross-section for describing an optical writing operation according to an optical print head 113.

FIG. 2 is a cross-section for describing an optical writing operation according to the optical print head 113. As shown in FIG. 2, the optical print head 113 includes an OLED panel 200, a rod lens array (SELFOC Lens Array) 202, and a holder 203. On the OLED panel 200 a plurality of OLEDs 201 are disposed in a line shape along the main scanning direction. The OLEDs 201 emit a light beam L and the rod lens array 202 focuses the light beam L on the outer circumferential surface of the photosensitive drum 111.

Figure 3:
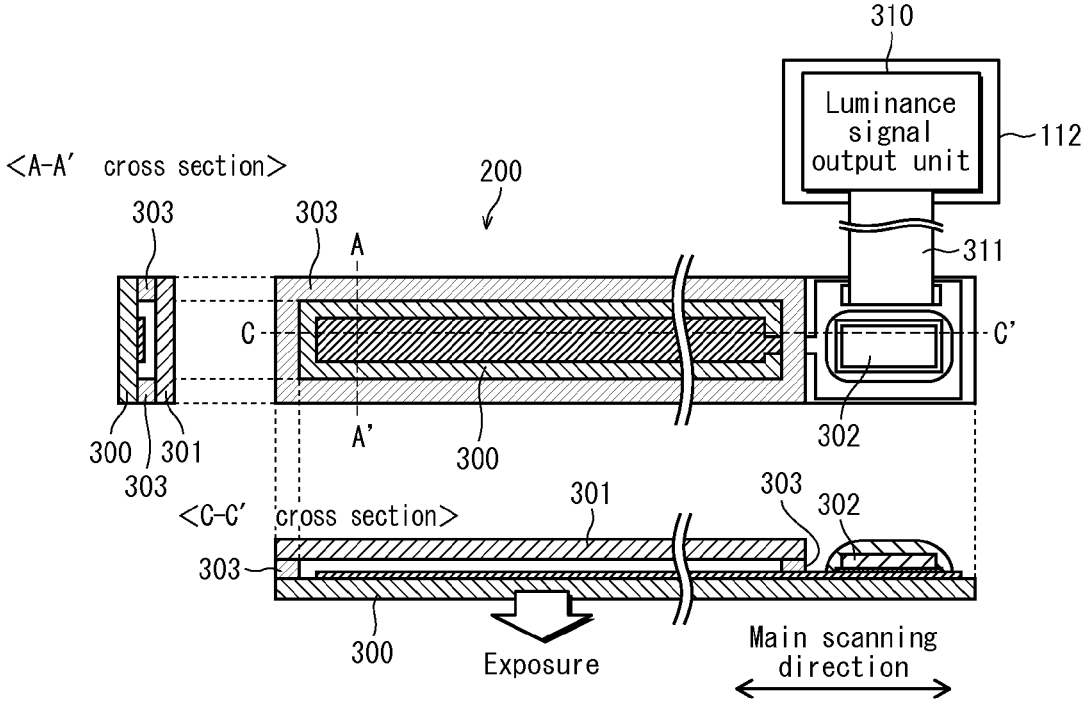
FIG. 3 includes a schematic plan view of an OLED panel 200 and also shows a cross section along the line A-A' and a cross section along the line C-C'.

FIG. 3 includes a schematic plan view of an OLED panel 200 and also shows a cross section along the line A-A' and a cross section along the line C-C'. Further, a portion of the schematic plan view shows a state in which a sealing plate (described later) is removed.

As shown in FIG. 3, the OLED panel 200 includes a TFT substrate 300, a sealing plate 301, and a driver integrated circuit (IC) 302. 15,000 OLEDs 201 are arranged in a line shape on the TFT substrate 300 along the main scanning direction at a pitch of 21.2 μm (1200 dpi). In this case, the OLEDs 201 in the line shape may be arranged in a single line or may have a staggered arrangement.

Further, a substrate surface on which the OLEDs 201 of the TFT substrate 300 are arranged is a sealed region surrounded by a spacer frame 303 on which the sealing plate 301 is mounted. In this way, the sealed region is sealed and filled with dry nitrogen or similar so as to not come into contact with ambient air. For moisture absorption, a moisture absorbent may also be sealed into the sealed region. The sealing plate 301 may be a sealing glass or may be composed of a material other than glass.

The driver IC 302 is mounted on the TFT substrate 300 outside the sealed region. The luminance signal output unit 310 of the controller 102 inputs a digital luminance signal to the driver IC 302 via a flexible wire 311. The driver IC 302 converts the digital luminance signal into an analog luminance signal (hereafter, "luminance signal") and inputs the analog luminance signal to drive circuits of the OLEDs 201. The drive circuits generate drive current for the OLEDs 201 according to the luminance signal. In the present embodiment, the luminance signal is a voltage signal.

(3) Configuration of Tft Substrate 300

The following is a description of major components of the TFT substrate 300.

Figure 4:
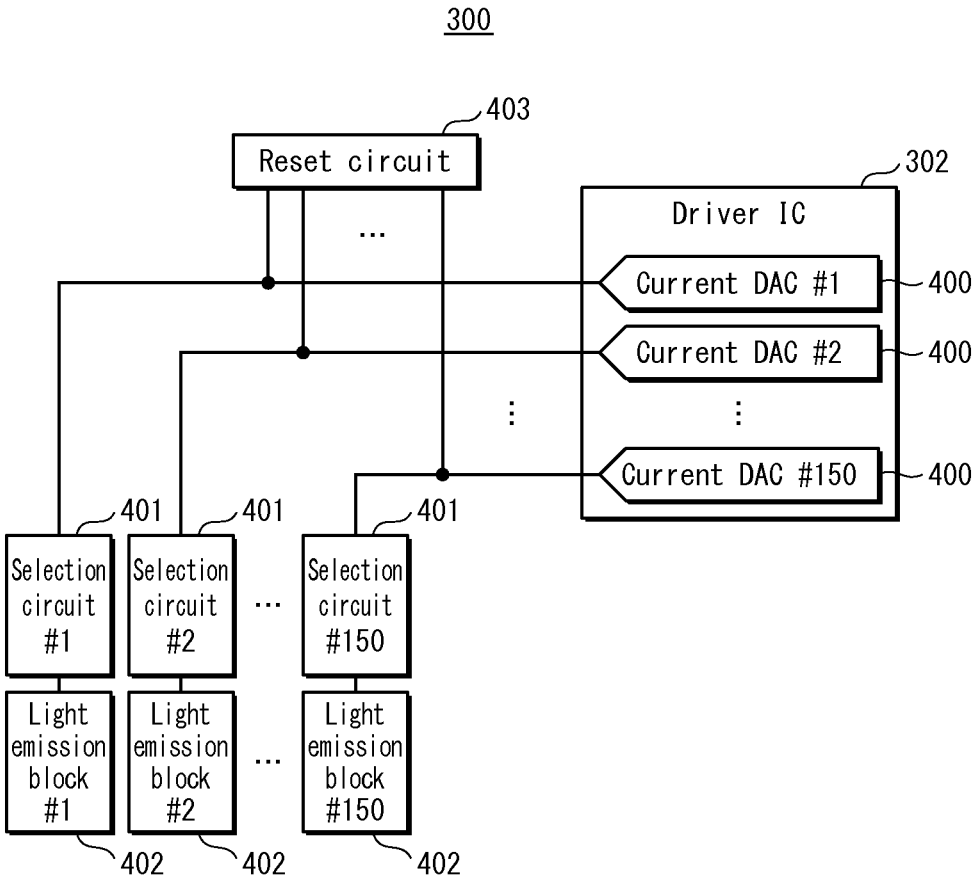
FIG. 4 shows major components of a TFT substrate 300.

As shown in FIG. 4, on the TFT substrate 300, the 15,000 OLEDs 201 are grouped into 150 light emitting blocks 402 of 100 each. Further, the driver IC 302 includes 150 current DACs 400 each of which corresponds with a respective one of the light emitting blocks 402. The current DACs are variable current sources that can be controlled digitally.

Selection circuits 401 are disposed one-for-one on the circuitry from the current DACs 400 to the light emitting blocks. Further, a reset circuit 403 is connected to the circuitry from the driver IC 302 to the selection circuits 401. Each of the current DACs 400 sequentially outputs a luminance signal to its subordinate 100 OLEDs 201 according to a "rolling drive".

Figure 5:
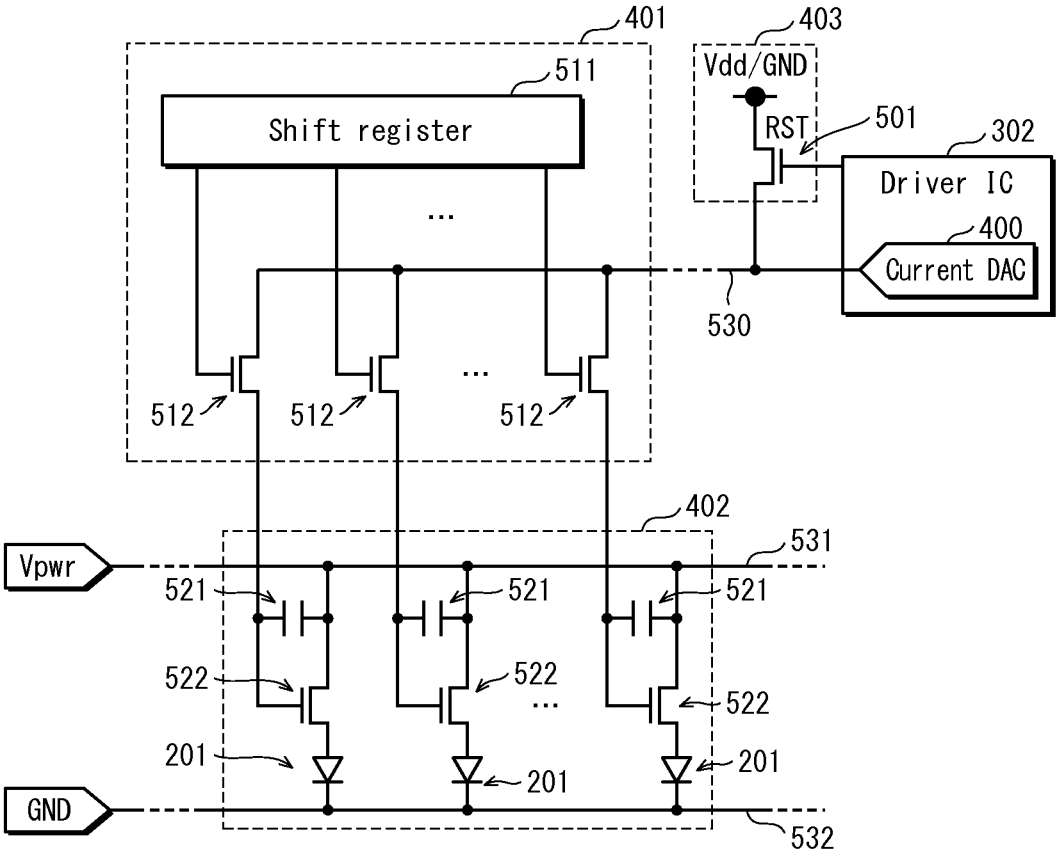
FIG. 5 is a circuit diagram showing a pair of a selection circuit 401 and a light emitting block 402.

FIG. 5 is a circuit diagram showing a pair of one of the selection circuits 401 and one of the light emitting blocks 402. As shown in FIG. 5, the one of the light emitting blocks 402 is composed of 100 light emitting pixel circuits and each of the light emitting pixel circuits has one of capacitors 521, one of drive TFTs 522, and one of the OLEDs 201. Further, the one of the selection circuits 401 has a shift register 511 and 100 selection TFTs 512, and the reset circuit 403 has a reset TFT 501.

The shift register 511 is connected to each gate terminal of the 100 selection TFTs 512 and sequentially switches on the selection TFTs 512. Source terminals of the selection TFTs 512 are connected to the one of the current DACs 400 via write wiring 530 and drain terminals are connected to gate terminals of the drive TFTs 522 and to first terminals of the capacitors 521.

When the shift register 511 switches on the selection TFTs 512, output current of the one of the current DACs 400 flows to the first terminals of the capacitors 521, causing the capacitors 521 to accumulate charge. The charge accumulated in the capacitors 521 is stored until reset by the reset circuit 403.

The first terminals of the capacitors 521 are also connected to the gate terminals of the drive TFTs 522 and second terminals of the capacitors 521 are connected to source terminals of the drive TFTs 522 and power supply wiring 531. Drain terminals of the drive TFTs 522 are connected to anode terminals of the OLEDs 201 and cathode terminals of the OLEDs are connected to ground wiring 532. Further, the power supply wiring 531 is connected to a constant-voltage source Vpwr and the ground wiring 532 is connected to a ground terminal.

The constant-voltage source Vpwr is a supply source of drive current supplied to the OLEDs 201 and the drive TFTs 522 supply drive current to the OLEDs 201 according to voltage stored across the first terminals and second terminals of the capacitors 521. For example, when a signal corresponding to "H" is written to one of the capacitors 521, a corresponding one of the drive TFTs 522 is switched on, and a corresponding one of the OLEDs 201 emits light. When a signal corresponding to "L" is written to one of the capacitors 521, a corresponding one of the drive TFTs 522 is switched off, and a corresponding one of the OLEDs 201 does not emit light.

When the reset TFT 501 is switched on, wiring from the one of the current DACs 400 to the capacitors 521 is reset to a reset potential. The reset potential may be a Vdd potential or a ground potential, or an appropriate potential may be selected. In the present embodiment, a case in which the OLEDs 201 do not emit light in a reset state is described, but a configuration in which the OLEDs do emit light in a reset state is also possible.

In the present embodiment, a case in which the drive TFTs 522 are p channels is described as an example, but of course n channel types of the drive TFTs 522 may also be used.

In the present embodiment, a configuration is described in which the reset circuit 403 is provided separately to the driver IC 302 and controlled under the driver IC 302, but instead of this configuration, the reset circuit 403 may be incorporated into the driver IC 302. Further, the function of the reset circuit 403 may be implemented by changing polarity of current that the one of the current DACs outputs when reset or writing. Further, instead of the reset TFT 501, a switching element other than a TFT may be used.

(4) Rolling Drive of Light Emitting Blocks 402

The following describes the rolling drive (reset, sample, and hold operation of the OLEDs 201) of the light emitting blocks 402.

Figure 6:
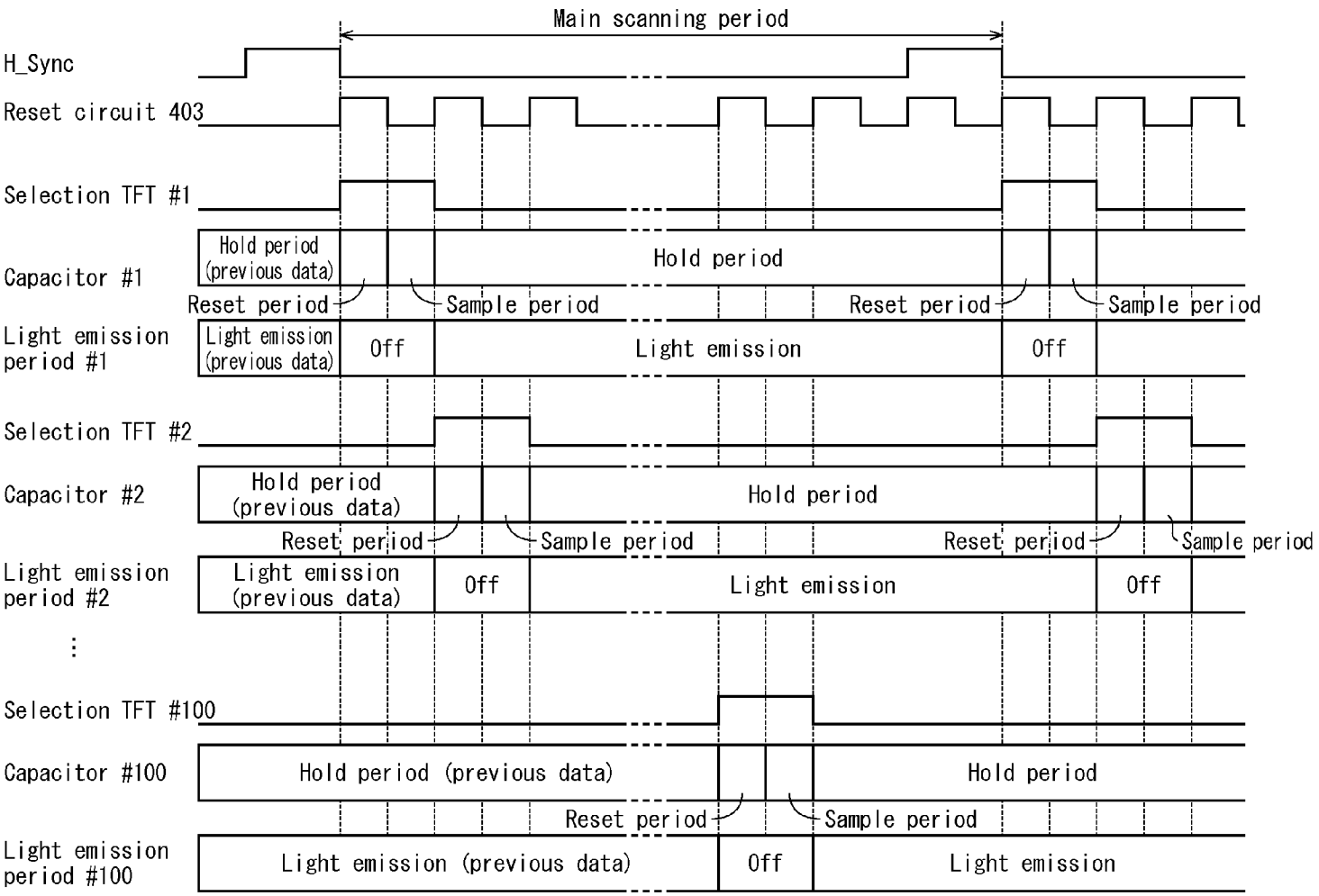
FIG. 6 is a timing chart showing reset, sample, and hold operations applied to an OLED 201.

In FIG. 6, a horizontal synchronization signal (H_Sync) is a main scanning period from a falling edge to a next falling edge. The reset circuit 403 synchronizes to the falling edge of the horizontal synchronization signal, switching the reset TFT 501 on and off. The selection circuits 401 also synchronize to the falling edge of the horizontal synchronization signal, switching the selection TFTs 512 on and off sequentially.

For each of the capacitors 521, a period which a corresponding one of the selection TFTs 512 is switched on is composed of a reset period in which the reset TFT 501 is switched on and a sample period in which the reset period continues. In a reset period, a corresponding one of the first terminals of a corresponding one of the capacitors 521 is reset to the reset potential. When the reset TFT 501 is switched off and a sample period starts, a charge is written to a corresponding one of the capacitors 521 by a corresponding one of the current DACs 400.

In a period in which one of the selection TFTs 512 is off (hold period), the charge written to a corresponding one of the capacitors 521 is held. When a gate voltage according to this charge amount is applied to a corresponding one of the drive TFTs 522, a drive current according to the charge amount is supplied to a corresponding one of the OLEDs 201. The one of the OLEDs 201 maintains a light emitting state (light emission amount) until the next reset period.

100 of the selection TFTs 512 are switched on and off sequentially by the shift register 511, and synchronized to this an output current amount of a corresponding one of the current DACs 400 is caused to change. In this way, charge is written to 100 of the capacitors 521 sequentially, and 100 of the OLEDs 201 each emit light of a desired light emission amount.

(5) Operation of Writing Charge According to Charge DACs 400

The following describes an operation of writing charge according to the charge DACs 400.

Figure 7:
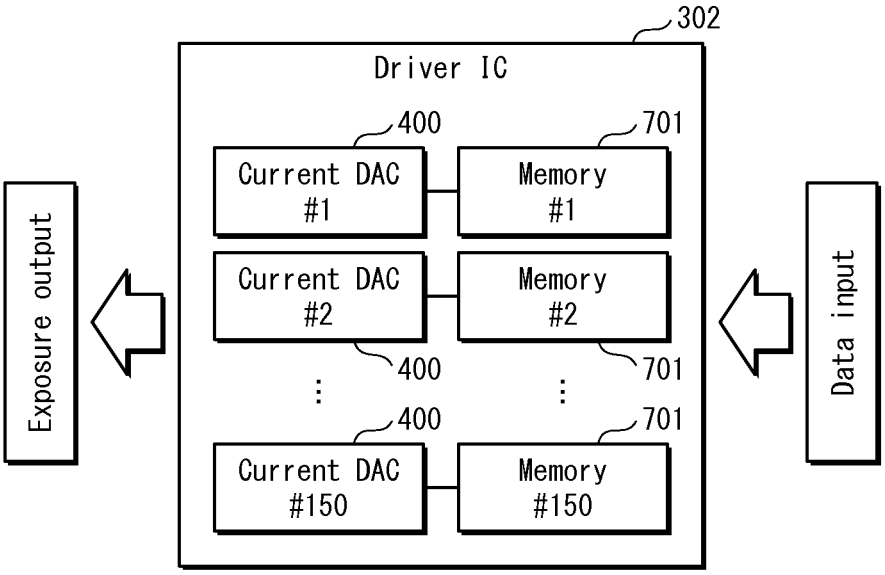
FIG. 7 is a block diagram showing major components of a driver integrated circuit (IC) 302.

As shown in FIG. 7, the driver IC 302 incorporates 150 of the charge DACs 400, each of which is provided with one of memories 701, which input writing data to corresponding charge DACs 400. Memory capacity of each of the memories 701 is six 8-bit words and during a sampling period a corresponding one of the memories 701 outputs writing data (digital signal) at ten nanosecond intervals six times. Each of the memories 701 can output different writing data each writing period of ten nanoseconds.

Further, the current DACs 400 are 8-bit current DACs that treat 0.2 μA, which is 51 μA divided by 255, as one least significant bit (LSB). In other words, each of the current DACs 400 outputs an output current amount increased by 0.2 μA to corresponding ones of the capacitors 521 for each increase of one LSB of writing data from a corresponding one of the memories 701. Capacitance of each of the capacitors 521 is 0.5 pF.

According to output current from one of the current DACs 400, voltage between the first terminal and the second terminal of a corresponding one of the capacitors 521, i.e. gate voltage Vg of a corresponding one of the drive TFTs 522, is calculated according to the following formula (1):

$$V_g = \left(\sum_{j=1}^{6} I_j \times T\right) \Big/ C \tag{1}$$

Here, $I_j$ (j=1, . . . , 6) represents output current at a $j^{th}$ writing period; T represents output time for each writing period, and in the present embodiment is ten nanoseconds; and C represents capacitance of one of the capacitors 521.

For example, in one writing period (ten nanoseconds), when a minimum output current of 0.2 μA flows, the voltage Vg between the first terminal and the second terminal of one of the capacitors 521 is as follows:

$$4\ \text{mV} = (0.2\ \mu\text{A}) \times (10\ \text{ns})/0.5\ \text{pF}$$

Further, in six writing periods, when a maximum output current of 51 μA flows, the voltage Vg is as follows:

$$6120\ \text{mV} = (51\ \mu\text{A}) \times (10\ \text{ns}) \times 6/0.5\ \text{pF}$$

When a maximum of the voltage Vg is no less than 6000 mV, a minimum is no greater than 6 mV, and 1,000 grades are implemented, uneven density can be suppressed to a degree that cannot be visually recognized. In the configuration of the present embodiment, the maximum voltage is 6120 mV and the minimum voltage is 4 mV, and therefore uneven density can be sufficiently suppressed.

FIG. 8 is a table showing writing data. As described above, in the sampling period, in each of six writing periods, eight bits of writing data are written from one of the memories 701 to a corresponding one of the current DACs 400. Further, each bit out of the eight bits, in order from an LSB to a most significant bit (MSB), corresponds to one of a current amount of 0.2 μA, 0.4 μA, 0.8 μA, 1.6 μA, 3.2 μA, 6.4 μA, 12.8 μA, and 25.6 μA.

In FIG. 8, in the first and the second writing periods all eight bits are set in the writing data, and therefore the one of the current DACs 400 outputs a current amount of 51.0 μA. Of course, 51 μA=0.2 μA+0.4 μA+0.8 μA+1.6 μA+3.2 μA+6.4 μA+12.8 μA+25.6 μA.

In the third writing data, the first bit is clear and therefore the current amount the one of the current DACs 400 outputs becomes 50.8 μA=0.4 μA+0.8 μA+1.6 μA+3.2 μA+6.4 μA+12.8 μA+25.6 μA.

In the same way, in the fourth writing data, the first bit and the second bit are clear and therefore the output current amount becomes 50.4 μA. The fifth and sixth output current amounts are similarly calculated. From these output current amounts, the gate voltage Vg calculated by using the formula (1) is 6000 mV.

Figure 9:
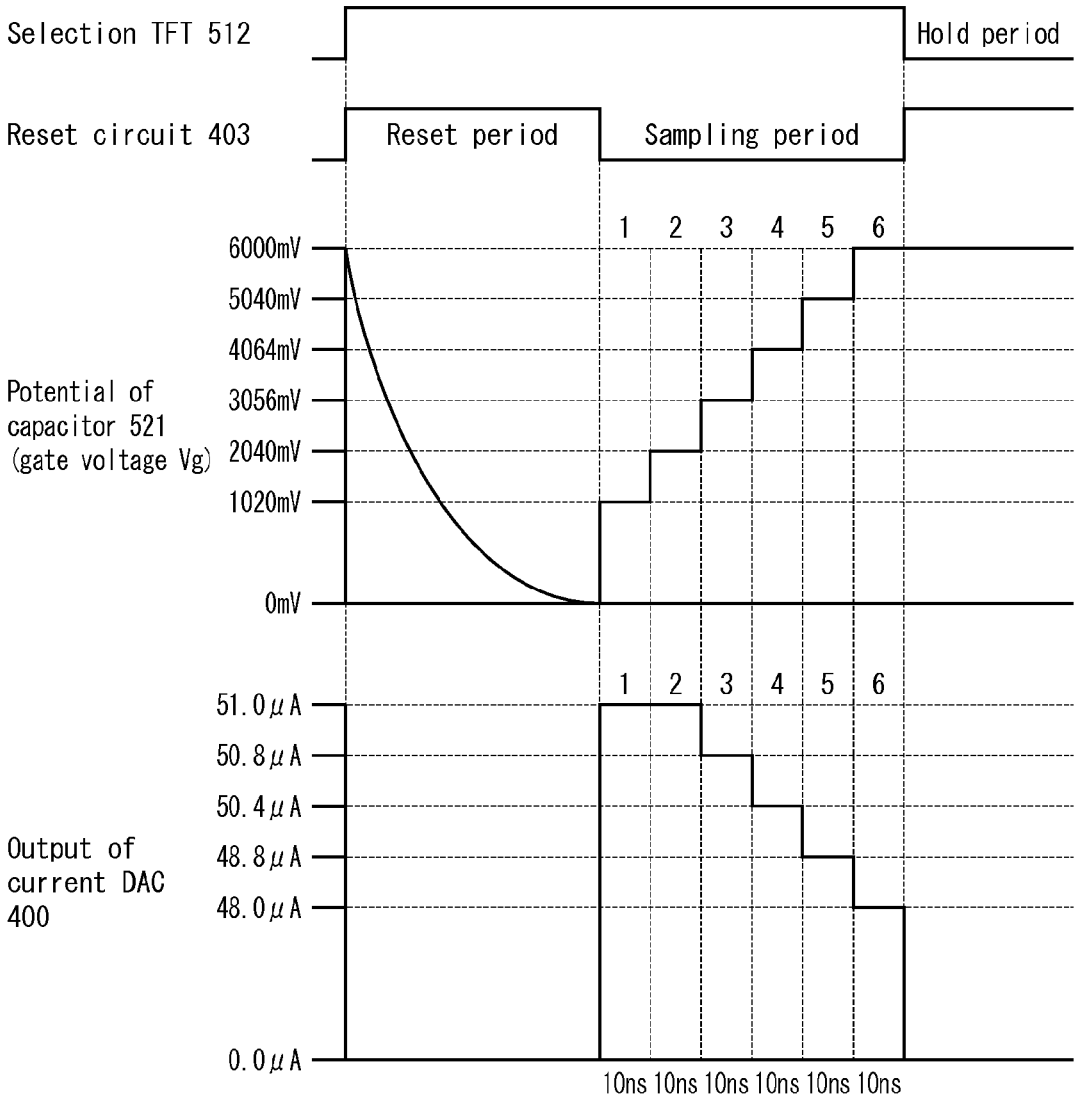
FIG. 9 is a timing chart illustrating a writing operation according to a current DAC 400.

FIG. 9 is a timing chart illustrating a writing operation according to one of the current DACs 400. In the example of FIG. 9, the data shown in the table of FIG. 8 is written. First, along with one of the selection TFTs 512 being switched off, the reset TFT 501 is switched on and the reset period starts, during which the potential held at the corresponding one of the capacitors 521 is reset. In the example of FIG. 9, according to the previous writing the gate voltage Vg starts at 6000 mV and is reset to 0 mV (ground potential). Accordingly, the corresponding one of the OLEDs 201 is turned off.

Subsequently, the reset TFT 501 is switched off, the sampling period starts, and current from the one of the current DACs 400 is outputted in six ten nanosecond periods. The output current amount of each writing period is as shown in FIG. 8. According to these current outputs, a charge is sequentially accumulated at the one of the capacitors 521 and light emission amount of the corresponding one of the OLEDs 201 also increases. The one of the OLEDs 201 finally emits light according to drive current supplied by the gate voltage Vg of 6000 mV.

As described above, accuracy of the gate voltage Vg is 4 mV, and therefore light amount unevenness of the OLEDs 201 is suppressed to no greater than 3%, which is not visible to the human eye. Subsequently, the one of the selection TFTs 512 is switched off and the hold period starts, during which the gate voltage Vg is held and the one of the OLEDs 201 maintains a light emitting state.

As described above, according to the present embodiment, the sample period is split into a plurality of writing periods and writing is performed changing output current amounts of the current DACs 400 in each writing period, and therefore there is no effect of voltage drop at the power supply wiring 531, low (eight) bit current DACs are used to reduce costs, and high accuracy writing is implemented with a wide dynamic range (DR) of 1,000 grades.

(6) Modifications

Above, the present invention is described based on the embodiment, but the present invention is of course not limited to the above embodiment, and the following modifications of the present invention may be implemented.

(1) The OLED-PH, as shown in FIG. 3, is long in the main scanning direction and the driver IC 302 is disposed at one end thereof. Thus, when comparing the closest one of the capacitors 521 to the driver IC 302 and the farthest one of the capacitors 521 from the driver IC 302, the writing wiring 530 from the driver IC 302 to the corresponding selection circuits 401 differs in length by approximately 30 cm, and a corresponding difference in wiring capacitance may cause light emittance unevenness among the OLEDs 201.

With respect to this problem, a correction circuit may be added to the driver IC 302, which prevents light emittance unevenness among the OLEDs 201 by correcting the output current amounts of the current DACs 400.

Figure 10:
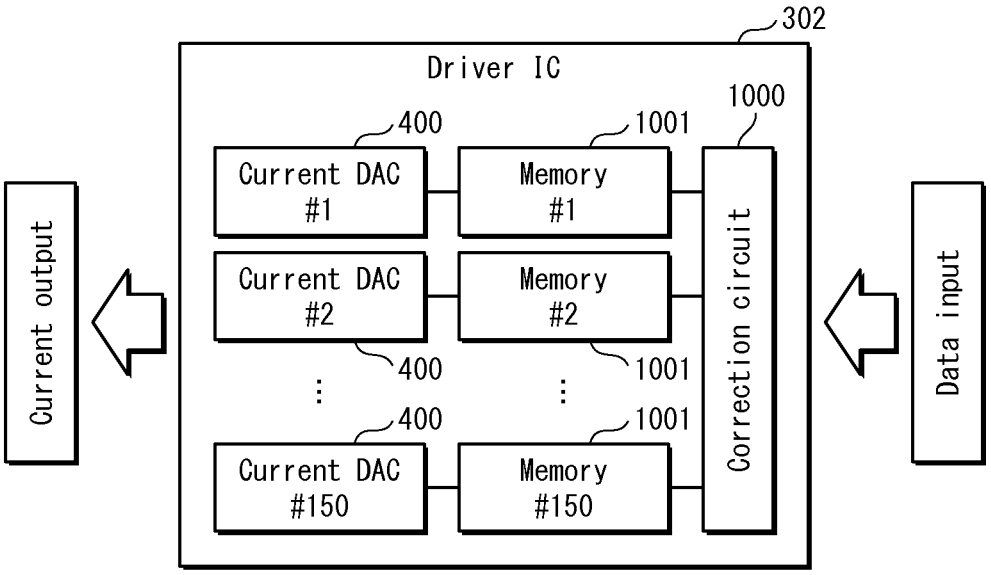
FIG. 10 is a block diagram showing major components of a driver IC 302 pertaining to a modification of the present invention.

FIG. 10 is a diagram showing major components of the driver IC 302 pertaining to the present modification. As shown in FIG. 10, the driver IC 302 pertaining to the present modification includes a correction circuit 1000 in addition to the current DACs 400 and memories 1001. In contrast to the embodiment above, according to which each of the memories 701 has a memory capacity of six 8-bit words, each of the memories 1001 pertaining to the present modification has a memory capacity of eight 8-bit words and during the sampling period each of the memories 1001 outputs writing data at ten nanosecond intervals eight times.

Upon receiving a digital luminance signal outputted from the luminance signal output unit of the controller 102, the correction circuit 1000 corrects the digital luminance signal according to which of the memories 1001 it should be should be written to. This correction may be performed by using a function in which numbers from 1 to 150 of the memories 1001 or the current DACs and luminance values are variables, may be performed by using numbers from 1 to 15,000 of the OLEDs 201 and luminance values are variables, and may be performed by referencing a look up table (LUT).

In a case in which a wiring capacitance C' from the one of the current DACs 400 to one of the capacitors 521 is sufficiently small compared to a capacitance C of the one of the capacitors 521, a relationship of an output current amount of the one of the current DACs 400 and a voltage Vg written to the one of the capacitors 521 is as described by the formula (1), above. However, when the wiring capacitance C' is too large to be ignored, the gate voltage Vg is described by formula (2), below.

$$V_g = \left(\sum_{j=1}^{6} I_j \times T\right) \Big/ (C + C') \tag{2}$$

Thus, for example, in a case in which wiring capacitance increases by 1% with respect to each 15 of the light emitting blocks 402, starting from the closest one of the OLEDs 201 to the driver IC 302, the gate voltage Vg can be corrected as shown in formula (3) as long as the output current amount of the current DACs 400 also increases by units of the light emitting blocks 402.

$$V_g = \left(\sum_{j=1}^{6} \left\{\frac{C + \left(1 + 0.01 \times \frac{n}{15}\right) \times C_{min}}{C} \times I_j\right\} \times T\right) \Big/ \tag{3}$$

-continued $$\left\{C + \left(1 + 0.01 \times \frac{n}{15}\right) \times C_{min}\right\}$$

Here, $C_{min}$ represents wiring capacitance from the driver IC 302 to the closest one of the capacitors 521. Further, n is a number defined such that zero represents the closest one of the light emitting blocks 402 to the driver IC 302 and every additional one of the light emitting blocks 402 in order from the driver IC 302 increments n by one.

Figure 11:
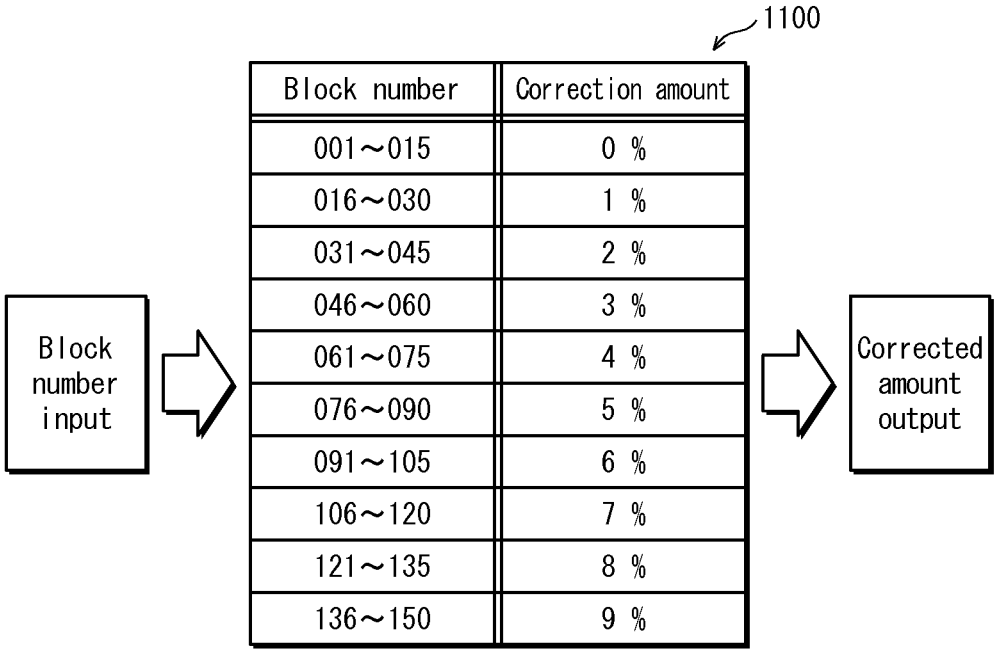
FIG. 11 is a diagram showing a look up table (LUT) pertaining to a modification of the present invention.

Further, correction may use an LUT. FIG. 11 is a diagram showing an LUT pertaining to the present modification. According to an LUT 1100, the 150 of the light emitting blocks 402 are allocated block numbers from 1 to 150 in order from the closest one of the light emitting blocks 402 to the driver IC 302. For example, a far end one of the light emitting blocks 402 has a block number of 150, and therefore 9% is outputted as a correction amount.

Further, a required total current amount is 300 μA when normalized over ten nanoseconds, and therefore an additional 27 μA (300 μA×9%) are required when performing writing with respect to the far end one of the light emitting blocks 402. FIG. 12 is a table showing the writing data of FIG. 8 as writing data after correction with respect to the far end one of the light emitting blocks 402.

According to FIG. 12, a correction charge of 27 μA×10 ns is added, and therefore 0.2 μA at the third word, 0.8 μA at the fifth word, 0.4 μA at the sixth word, and 25.6 μA at the seventh word are added to the writing data. Note that with respect to the fifth word, in FIG. 8 the third bit is set and the fourth bit is cleared, and therefore to add 0.8 μA, the third bit is cleared and the fourth bit is set as shown in FIG. 12.

Figure 13A:
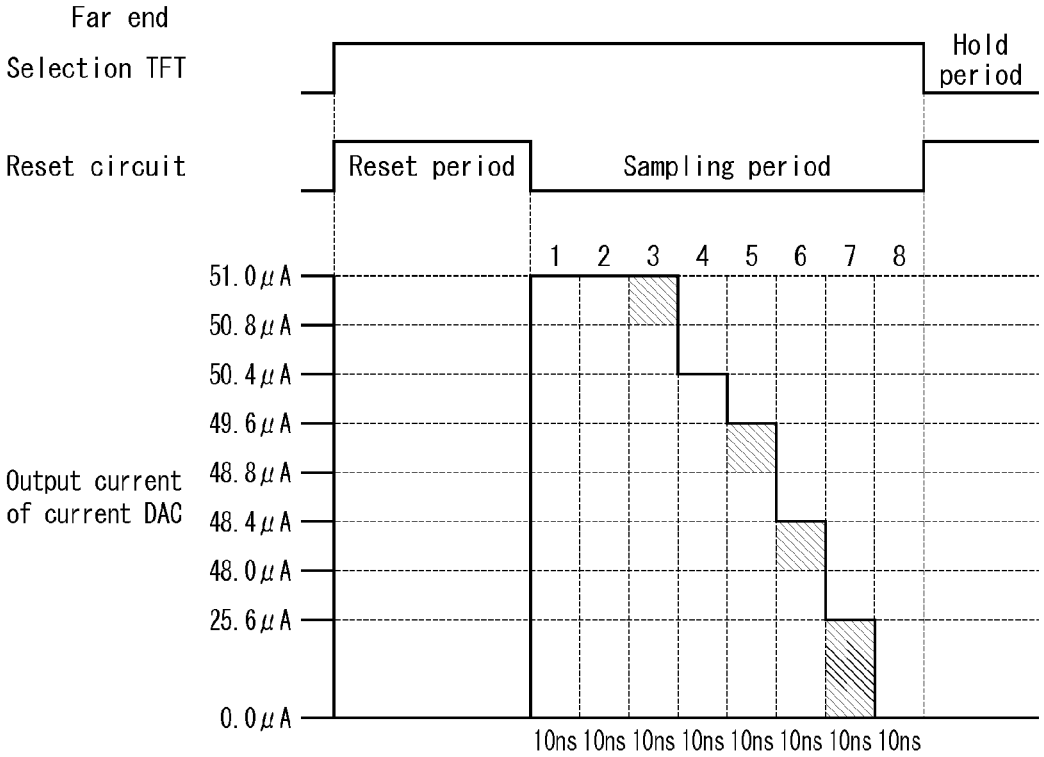
FIG. 13A and FIG. 13B include timing charts illustrating a writing operation pertaining to a modification of the present invention.
Figure 13B:
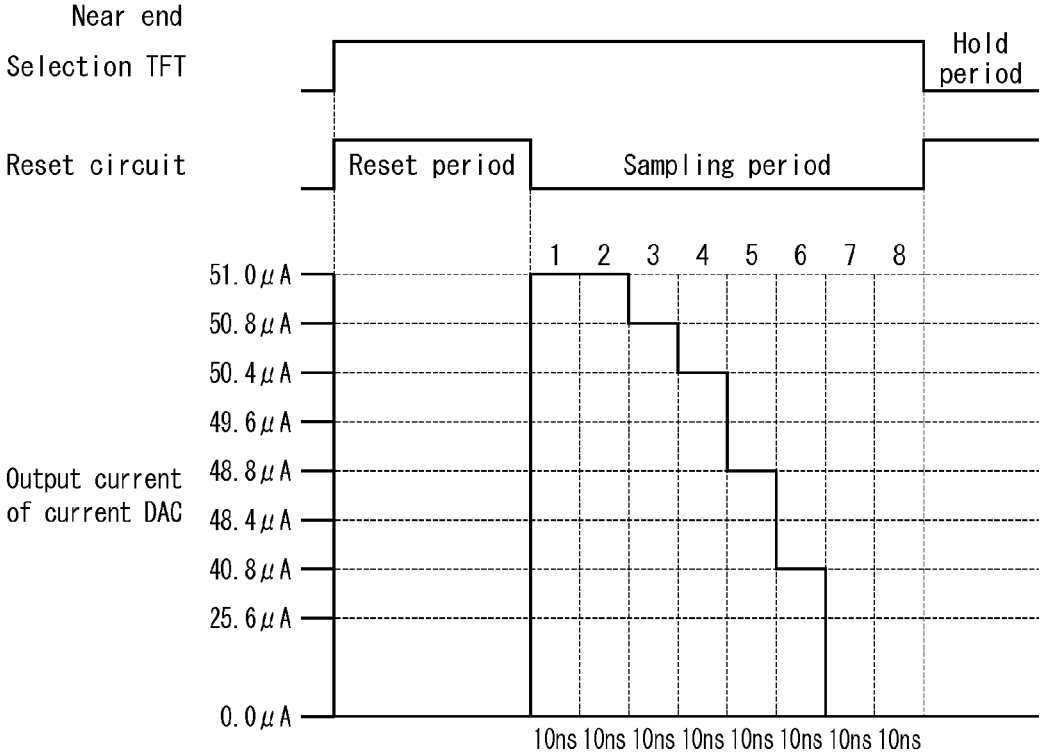

Further, FIG. 13A and FIG. 13B are timing charts showing a case in which the far end one of the light emitting blocks 402 and a near end one of the light emitting blocks 402 are caused to emit the same amount of light. FIG. 13A shows the far end one of the light emitting blocks 402 from the driver IC 302 and FIG. 13B shows the near end one of the light emitting blocks 402. As shown in FIG. 13A and FIG. 13B, the writing data shown in FIG. 12 is used with respect to the far end one of the light emitting blocks 402 and the writing data shown in FIG. 8 is used with respect to the near end one of the light emitting blocks 402.

In this way, by correcting writing data according to distance from the driver IC 302 of the light emitting blocks 402, writing errors caused by difference in wiring length (wiring capacitance) of the writing wiring 530 is suppressed, and therefore unevenness in light emission amounts can be suppressed.

Note that in FIG. 13A, data is created in the third, fifth, and sixth words, in which data already exists, and the seventh word, which is yet to be used with respect to the near end one of the light emitting blocks 402. However, the present invention is of course not limited in this way, and additional bits may be set as follows. For example, correction may be performed using only bits of words in which data exists with respect to the near end one of the light emitting blocks 402, and of course correction may be performed using only bits of words that are yet to be used with respect to the near end one of the light emitting blocks 402.

Using the example of FIG. 13A, in the third, fifth, and sixth words in which bits are set according to the data of the near end one of the light emitting blocks 402, the data of the far end one of the light emitting blocks 402 may be created only correcting cleared bits to set bits. Further, as with the seventh word of the data of the near end one of the light emitting blocks 402, the data of the far end one of the light emitting blocks 402 may be created by setting appropriate bits in words that have yet to be used, i.e. in which all bits are cleared.

Further, writing errors may be corrected by using a correction formula other than the formula (3), above.

In a case in which a correction formula is used, and in a case in which an LUT is used, writing should of course be performed using data closest to writing data calculated after correction and that has the smallest error relative to the data after correction.

(2) The wiring capacitance of the writing wiring 530 changes according to magnitude of the wiring length and width. Thus, effects due to differences in wiring capacitance can be reduced by adjusting wiring length and/or width with respect to each of the light emitting blocks 402.

For example, the difference in wiring capacitance between the far end of one of the light emitting blocks 402 and the near end one of the light emitting blocks 402 can be reduced by increasing the wiring width and/or length of the writing wiring 530 to the near end one of the light emitting blocks 402 in order to match the writing wiring 530 to the far end one of the light emitting blocks 530.

Figures 14, 15:
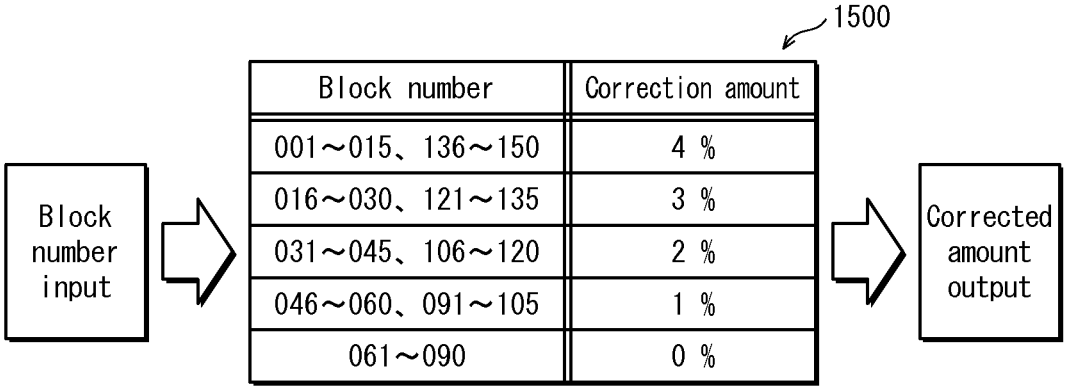
FIG. 14 is a table listing numbers of light emitting blocks 402 that have substantially the same wiring capacitance according to a modification of the present invention.
FIG. 15 is a diagram showing an LUT pertaining to a modification of the present invention.
Figure 16:
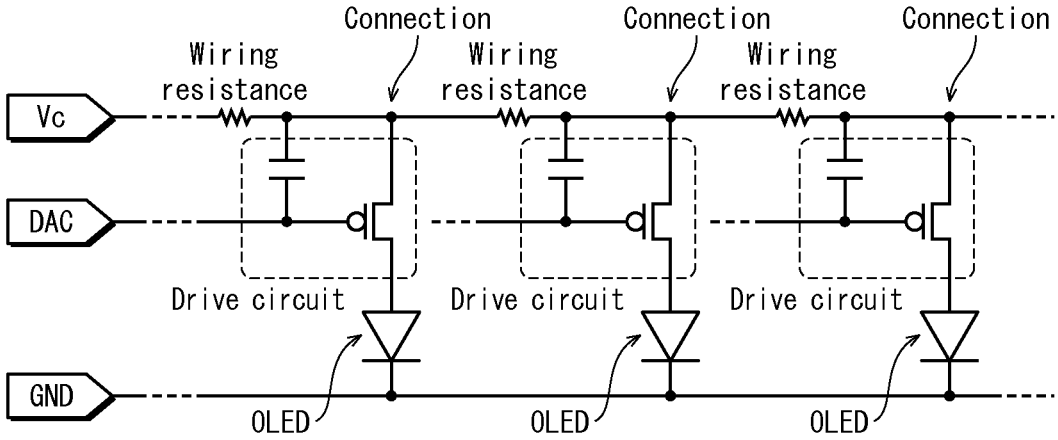
FIG. 16 Prior Art
FIG. 16 illustrates a configuration of an optical print head pertaining to conventional technology.
Figure 17A:
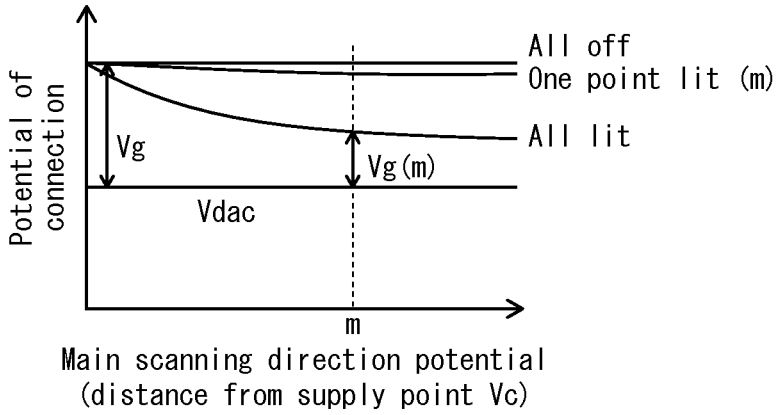
FIG. 17A and FIG. 17B are diagrams for describing voltage drop in power supply wiring.
Figure 17B:
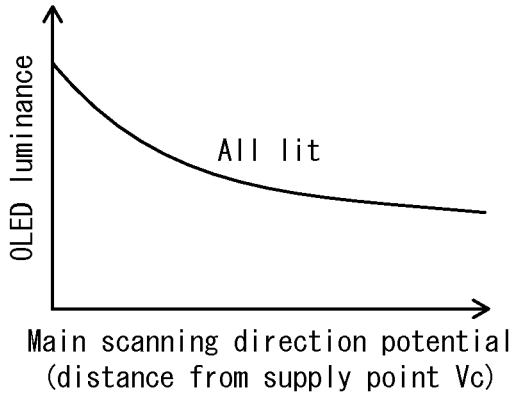

In this way, by taking a central portion of the main scanning direction as an axis of symmetry and by adjusting wiring width and length, wiring capacitance can be made substantially the same among the light emitting blocks 402 disposed in symmetrical positions, as shown in the table of FIG. 14, and therefore size of an LUT can be reduced.

FIG. 15 is a diagram showing an LUT pertaining to the present modification. In contrast to the LUT 1100 of FIG. 11, in which the correction amounts have ten ranks from 0% to 9%, an LUT 1500 shown in FIG. 15 has correction amounts in five ranks from 0% to 4%, which is half that of the LUT 1100. Thus, by adjusting wiring width and length of the writing wiring 530 to reduce differences in wiring capacitance, size of the LUT can be reduced, and therefore memory capacity of the driver IC 302, which is required to store the LUT, can be reduced and a cost reduction achieved.

According to the embodiment above, cases are described in which current DACs can receive writing data in the form of six 8-bit words or eight 8-bit words, but the present invention is of course not limited in this way. Writing data of less than eight bits and writing data of word counts other than six words or eight words may be received.

Further, according to the embodiment above, a case is described in which length of the writing periods is ten nanoseconds, but the present invention is of course not limited in this way. Period lengths other than ten nanoseconds may be used and differing period lengths among writing periods in the same one of the sampling periods.

According to the embodiment above, a case is described in which the image forming apparatus is a tandem-type color printer but the present invention is of course not limited in this way. The image forming apparatus may be a color printer device other than a tandem-type, and may be a monochrome printer device. Further, effects of the present invention can be achieved even when the present invention is applied to a copying device incorporating a scanner, a facsimile device incorporating a communication function, or a multi-function peripheral (MFP) incorporating several such functions.

(7) Summary

As described above, the optical print head pertaining to the present embodiment is an optical print head for forming an electrostatic latent image on a photosensitive body, the optical print head comprising: a plurality of current-driven light-emitting elements disposed in a line shape; an indicator circuit that outputs indicator current indicating light emission amounts to the light-emitting elements; and for each light-emitting element among the light-emitting elements: a corresponding holding circuit that, during a main scanning period, accumulates indicator current during a corresponding sample period to generate an indicator potential and holds the indicator potential during a corresponding hold period; and a corresponding drive circuit that supplies drive current to the light-emitting element according to the indicator potential, wherein each of the sample periods is divided into a plurality of writing periods, and each of the holding circuits holds the indicator potential corresponding to the holding circuit according to a total of indicator current amounts in the sample period corresponding to the holding circuit, the indicator current amounts each indicative of indicator current during one of the writing periods.

Thus, drive current amounts are controlled by indicator voltages according to indicator current amounts, and therefore influence of voltage drop in power supply wiring is avoided and uneven luminance is prevented.

Further, the holding circuits hold indicator potential according to the total of indicator current amounts for each of the writing periods and therefore, when compared to conventional technology that only has one writing period per sample period, a dynamic range of indicator current outputted by the indicator circuit is not caused to increase but a dynamic range of indicator potential held by the holding circuits is increased.

Accordingly, the indicator circuit can be implemented at lower cost.

Further, when the indicator circuit controls the indicator current amounts outputted with respect to each of the writing periods, resolution of indicator potential held by the holding circuits can be increased.

Specifically, it is preferable that the indicator circuit controls the indicator current amounts based on a plurality of control signals for each of the writing periods, and further preferred that the control signals correspond to differing current amounts, and the indicator circuit controls the indicator current amounts according to sums of the current amounts corresponding to the control signals.

Further, a switching unit may change which of the holding circuits receives indicator current outputted by the indicator circuit in each of the sample periods.

Thus, a plurality of the holding circuits can share the same indicator circuit in common, and therefore circuitry of the optical print head can be made compact, requiring less space and reducing costs.

Further, a correction unit may correct the totals of the indicator current amounts in the sample periods according to wiring capacitance of wiring from the indicator circuit to the holding circuits.

Thus, lighting unevenness caused by the wiring capacitance can be prevented.

In such a case, it is preferable that the correction unit corrects the totals the indicator current amounts in the sample periods by correcting the indicator current amounts outputted in at least one of the writing periods.

Further, when wiring capacitance of wiring from the indicator circuit to each of the holding circuits is substantially the same, a quantity of circuit elements required for preventing lighting unevenness caused by wiring capacitance can be reduced.

In such a case, it is preferable that the wiring capacitance being substantially the same is due to adjustments in at least one of wiring length and wiring width.

Further, when a range of variation of wiring capacitance between wiring is suppressed by adjusting at least one of wiring length and wiring width of wiring from the indicator circuit to the holding circuits, and the optical print head further comprises: a correction unit that corrects the totals of indicator current amounts in the sample periods according to variation in wiring capacitance between wiring from the indicator circuit to the holding circuits, circuit scale required to implement the correction unit can be reduced.

Further, the sample periods should of course include reset periods prior to the writing periods, and the optical print head further comprises a reset unit that resets, in the reset periods, the indicator potential held by the holding circuits.

In such a case, by ensuring that the reset unit is common to a plurality of the holding circuits, circuitry required for implementing the reset unit can be simplified.

Further, the light-emitting elements disposed in the line shape may be arranged in a plurality of rows in a longitudinal direction of the line shape, and the drive circuits may be arranged in a plurality of rows in the longitudinal direction.

Further, when the light-emitting elements are organic light-emitting diodes (OLEDs), manufacturing cost of the optical print head can be reduced.

Further, the light-emitting elements and the drive circuits may be mounted on a common substrate, thereby promoting space saving via high-density mounting.

The image forming device pertaining to the present embodiment includes the optical print head pertaining to the present embodiment, and therefore the effects above can of course be obtained.

Although the present invention has been fully described by way of examples with reference to the accompanying drawings, it is to be noted that various changes and modifications will be apparent to those skilled in the art. Therefore, unless such changes and modifications depart from the scope of the present invention, they should be construed as being included therein.

What is claimed is:

1. An optical print head for forming an electrostatic latent image on a photosensitive body, the optical print head comprising:

a plurality of current-driven light-emitting elements disposed in a line shape;

an indicator circuit that outputs indicator current indicating light emission amounts to the light-emitting elements; and for each light-emitting element among the light-emitting elements:

a corresponding holding circuit that, during a main scanning period, accumulates indicator current during a corresponding sample period to generate an indicator potential and holds the indicator potential during a corresponding hold period; and a corresponding drive circuit that supplies drive current to the light-emitting element according to the indicator potential, wherein each of the sample periods is divided into a plurality of writing periods, and each of the holding circuits holds the indicator potential corresponding to the holding circuit according to a total of indicator current amounts in the sample period corresponding to the holding circuit, the indicator current amounts each indicative of indicator current during one of the writing periods.

2. The optical print head of claim 1, wherein the indicator circuit controls the indicator current amounts outputted with respect to each of the writing periods.

3. The optical print head of claim 2, wherein the indicator circuit controls the indicator current amounts based on a plurality of control signals for each of the writing periods.

4. The optical print head of claim 3, wherein the control signals correspond to differing current amounts, and the indicator circuit controls the indicator current amounts according to sums of the current amounts corresponding to the control signals.

5. The optical print head of claim 1, further comprising:

a switching unit that changes which of the holding circuits receives indicator current outputted by the indicator circuit in each of the sample periods.

6. The optical print head of claim 1, further comprising:

a correction unit that corrects the totals of the indicator current amounts in the sample periods according to wiring capacitance of wiring from the indicator circuit to the holding circuits.

7. The optical print head of claim 6, wherein the correction unit corrects the totals the indicator current amounts in the sample periods by correcting the indicator current amounts outputted in at least one of the writing periods.

8. The optical print head of claim 1, wherein wiring capacitance of wiring from the indicator circuit to each of the holding circuits is substantially the same.

9. The optical print head of claim 8, wherein the wiring capacitance being substantially the same is due to adjustments in at least one of wiring length and wiring width.

10. The optical print head of claim 1, wherein a range of variation of wiring capacitance between wiring is suppressed by adjusting at least one of wiring length and wiring width of wiring from the indicator circuit to the holding circuits, and the optical print head further comprises:

a correction unit that corrects the totals of indicator current amounts in the sample periods according to variation in wiring capacitance between wiring from the indicator circuit to the holding circuits.

11. The optical print head of claim 1, wherein the sample periods include reset periods prior to the writing periods, and the optical print head further comprises a reset unit that resets, in the reset periods, the indicator potential held by the holding circuits.

12. The optical print head of claim 11, wherein the reset unit is common to a plurality of the holding circuits.

13. The optical print head of claim 12, wherein the light-emitting elements disposed in the line shape are arranged in a plurality of rows in a longitudinal direction of the line shape, and the drive circuits are arranged in a plurality of rows in the longitudinal direction.

14. The optical print head of claim 1, wherein the light-emitting elements are organic light-emitting diodes (OLEDs).

15. The optical print head of claim 1, wherein the light-emitting elements and the drive circuits are mounted on a common substrate.

16. An image forming device including an optical print head for forming an electrostatic latent image on a photosensitive body, the optical print head comprising:

a plurality of current-driven light-emitting elements disposed in a line shape;

an indicator circuit that outputs indicator current indicating light emission amounts to the light-emitting elements; and for each light-emitting element among the light-emitting elements:

a corresponding holding circuit that, during a main scanning period, accumulates indicator current during a corresponding sample period to generate an indicator potential and holds the indicator potential during a corresponding hold period; and a corresponding drive circuit that supplies drive current to the light-emitting element according to the indicator potential, wherein each of the sample periods is divided into a plurality of writing periods, and each of the holding circuits holds the indicator potential corresponding to the holding circuit according to a total of indicator current amounts in the sample period corresponding to the holding circuit, the indicator current amounts each indicative of indicator current during one of the writing periods.

* * * * *